US009139975B2

(12) United States Patent
Rochel et al.

(10) Patent No.: US 9,139,975 B2
(45) Date of Patent: Sep. 22, 2015

(54) MACHINE BUCKET

(75) Inventors: Ryan A. Rochel, Montgomery, IL (US); Jeremy D. Folkerts, Naperville, IL (US); Samuel L. McClallen, Eureka, IL (US)

(73) Assignee: Caterpillar Inc., Peoria, IL (US)

( * ) Notice: Subject to any disclaimer, the term of this patent is extended or adjusted under 35 U.S.C. 154(b) by 770 days.

(21) Appl. No.: 13/485,587

(22) Filed: May 31, 2012

(65) Prior Publication Data

US 2013/0323000 A1 Dec. 5, 2013

(51) Int. Cl.
*E02F 3/40* (2006.01)
*E02F 9/28* (2006.01)

(52) U.S. Cl.
CPC ..... *E02F 3/40* (2013.01); *E02F 9/2825* (2013.01); *E02F 9/2883* (2013.01)

(58) Field of Classification Search
CPC ..... E02F 3/40; E02F 3/401; E02F 3/407; E02F 3/4075; E02F 3/345; E02F 9/2825; E02F 9/2833; E02F 9/2883
USPC ..... 37/444, 443, 379, 411, 445; 414/722–724; D15/25, 32
See application file for complete search history.

(56) References Cited

U.S. PATENT DOCUMENTS

| | | | |
|---|---|---|---|
| 1,653,905 | A | 12/1927 | Harrison |
| 2,916,135 | A | 12/1959 | Likens, Jr. |
| 2,924,345 | A | 2/1960 | Bodin |
| 2,972,425 | A | 2/1960 | Anderson et al. |
| 3,130,843 | A | 4/1964 | Kelly |
| 3,243,906 | A | 4/1966 | Washbond |
| 3,398,472 | A | 8/1968 | Leijon |
| 3,648,391 | A | 3/1972 | Kabay et al. |
| 3,775,879 | A | 12/1973 | Quick |
| 3,807,587 | A | 4/1974 | Maurer |
| RE29,603 | E | 4/1978 | Oke et al. |
| 4,086,712 | A | 5/1978 | McReynolds |
| 4,187,050 | A | 2/1980 | Barbee |
| 4,279,085 | A | 7/1981 | Arnold |
| 4,395,193 | A | 7/1983 | Christensen et al. |
| 4,457,085 | A | 7/1984 | Arnold |
| 4,459,768 | A | 7/1984 | Albrecht |

(Continued)

FOREIGN PATENT DOCUMENTS

| | | |
|---|---|---|
| JP | 59041533 | 3/1984 |
| JP | 01214623 | 8/1989 |

OTHER PUBLICATIONS

Diagram and Table of Prior Art Bucket Parameters #1.

(Continued)

*Primary Examiner* — Robert Pezzuto
(74) *Attorney, Agent, or Firm* — Finnegan, Henderson, Farabow, Garrett & Dunner, LLP

(57) ABSTRACT

A machine bucket may include a wrapper. The wrapper may form a portion of a receptacle for holding material. The wrapper may include a curved upper portion defining an arc. The curved upper portion may have a central angle value ($\theta_U$) of between approximately 109.5° and 110.5'. The wrapper may also include a curved lower portion defining an arc. The curved lower portion may have a central angle value ($\theta_L$) of between approximately 44.5° and 45.5°. Such a machine bucket finds particular utility collecting and transporting material that is adherent to itself and the surfaces of the bucket.

19 Claims, 4 Drawing Sheets

(56) References Cited

U.S. PATENT DOCUMENTS

| | | | |
|---|---|---|---|
| 4,523,397 | A | 6/1985 | Lucas |
| 4,633,601 | A | 1/1987 | Fleck et al. |
| 4,854,813 | A | 8/1989 | Degeeter et al. |
| D308,528 | S | 6/1990 | Harr |
| 5,494,396 | A | 2/1996 | Geier et al. |
| 5,813,822 | A | 9/1998 | Pisco |
| 5,815,959 | A | 10/1998 | Bahner et al. |
| 5,992,062 | A | 11/1999 | Evans et al. |
| 6,374,520 | B1 | 4/2002 | Westendorf et al. |
| D469,786 | S | 2/2003 | Miller et al. |
| 6,581,308 | B1 | 6/2003 | Woerman et al. |
| 6,766,602 | B2 | 7/2004 | Cox et al. |
| D524,826 | S | 7/2006 | Boyapally et al. |
| 8,015,734 | B1 | 9/2011 | Mills et al. |
| 8,201,350 | B2 | 6/2012 | Folkerts et al. |

OTHER PUBLICATIONS

Diagrams and Tables of Prior Art Bucket Parameters #2.

MACHINE BUCKET

TECHNICAL FIELD

This disclosure relates generally to machine buckets, and more particularly, to performance enhancing machine buckets.

BACKGROUND

A machine, such as an excavator, may be equipped with a bucket to perform operations at a work site. Such operations may include, for example, penetrating material in the ground or in a pile to prepare building sites, loading material into trucks or onto conveyors, making cuts through hillsides, and digging trenches. The level of performance achieved by an excavator operator using the excavator may depend, at least partially, on one or more parameters of the bucket and the relationship of those parameters to the characteristics of the material through which the bucket is passed to load it. Using a bucket having parameters matched to the material being operated on with the bucket may provide a level of performance that significantly differs from the level achieved while performing similar operations using another bucket that has one or more different parameters.

SUMMARY

In accordance with one aspect, the present disclosure is directed to a machine bucket. The machine bucket includes a wrapper forming a portion of a receptacle for holding material. The wrapper includes a curved upper portion defining an arc. The curved upper portion arc may have a central angle value ($\theta_U$) of between approximately 109.5° and 110.5°. The wrapper also includes a curved lower portion defining an arc. The curved lower portion arc may have a central angle value ($\theta_L$) of between approximately 44.5° and 45.5°.

In accordance with another aspect, the present disclosure is directed to a machine bucket. The machine bucket includes a torque tube having an outer surface. The machine bucket also includes a support plate coupled to the torque tube. The support plate includes a bottom surface lying in a first plane. The machine bucket further includes a cutting edge including a cutting edge tip. The machine bucket also includes a wrapper between the support plate and the cutting edge. The machine bucket may further include a depth (D') to length (L') ratio of between approximately 0.69 and 0.72. The length (L') extends in a second plane from the cutting edge tip to a portion of the outer surface of the torque tube. The portion of the outer surface is located where the first plane intersects the outer surface of the torque tube. The depth (D') equals a maximum distance between the second plane and the wrapper, taken substantially perpendicularly from the second plane.

In accordance with another aspect, the present disclosure is directed to a machine bucket. The machine bucket includes a top section. The top section includes a support plate and a torque tube coupled to the support plate. The machine bucket also includes a bottom section including a cutting edge. The machine bucket further includes a middle section including a wrapper. The wrapper extends between the torque tube and the cutting edge. The wrapper includes an upper portion coupled to the support plate, a lower portion coupled to the cutting edge, and a curved heel portion between the upper portion and the lower portion. An angle ($\theta_T$) between the upper portion and the lower portion may have a value of approximately 25°. An angle ($\theta_1$) between the tip of the tip of the cutting edge and a line perpendicular to the lower portion that passes through the center of an upper pin bore in the support plate may have a value of approximately 35°. The machine bucket may also include a depth (D') to length (L') ratio of between approximately 0.69 and 0.72. A distance between a tip of the cutting edge and a portion of an outer surface of the torque tube, the portion of the outer surface lying in a first plane containing a bottom surface of the support plate, may define the length (L'). A maximum distance between a second plane containing the length (L') and the wrapper, taken substantially perpendicularly from the second plane, may define the depth (D').

DETAILED DESCRIPTION

FIGS. 1-4 illustrate a performance enhancing bucket 10. Bucket 10 may be a component of a machine (not shown). The machine may embody a mobile machine, such as an excavator or any other machine, that may perform operations associated with an industry, including, for example, mining, construction, farming, or transportation. The machine may include a linkage assembly (not shown) coupled to bucket 10, including one or more supporting members and actuators for moving bucket 10 to perform operations, including engaging, scooping, lifting, transporting, lowering, and dumping material.

Figure 1:
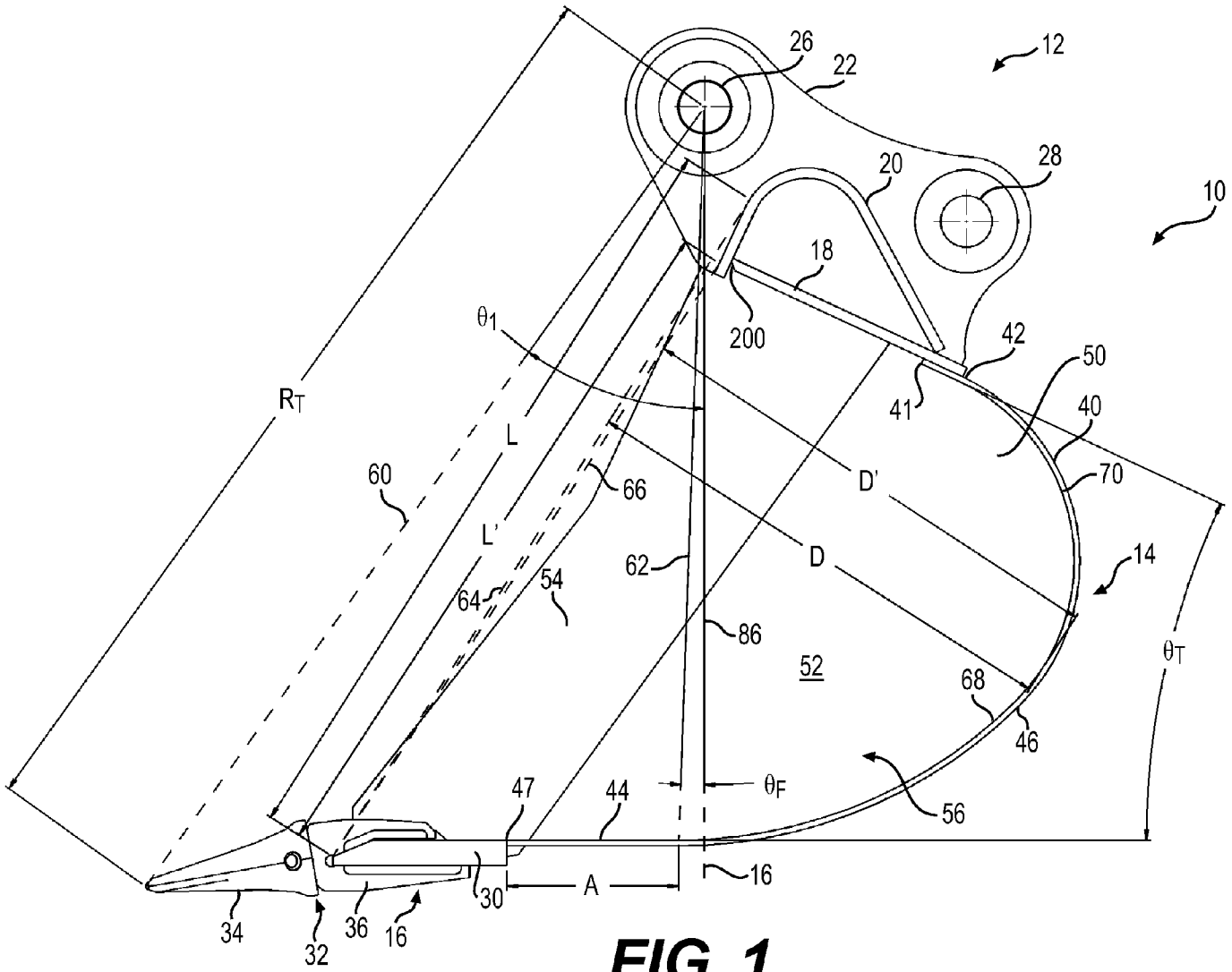
FIG. 1 is a side view of a bucket in accordance with this disclosure, including markings to identify bucket parameters.
Figure 3:
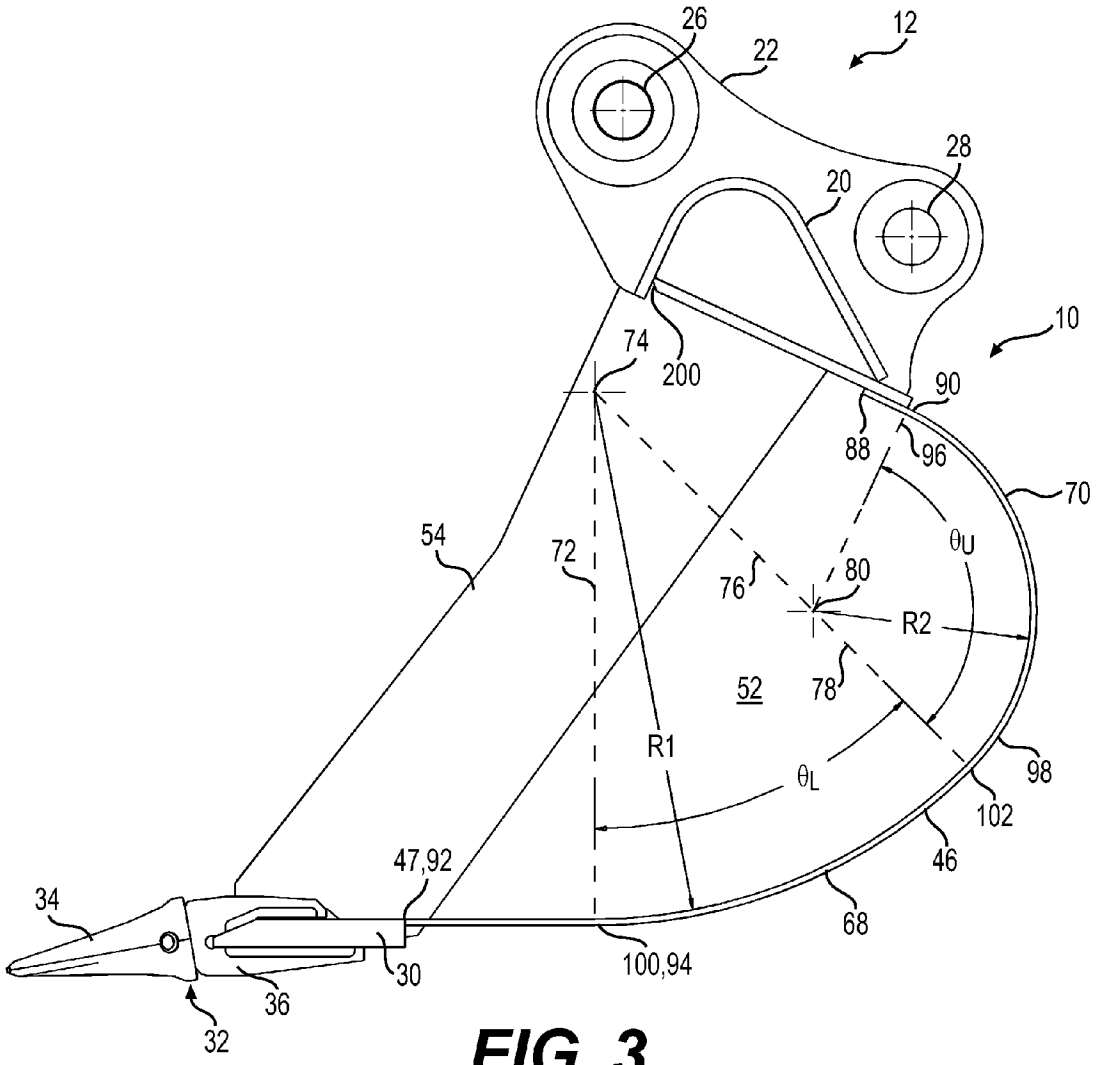
FIG. 3 is the bucket side view of FIG. 1 including markings to identify additional bucket parameters.
Figure 4:
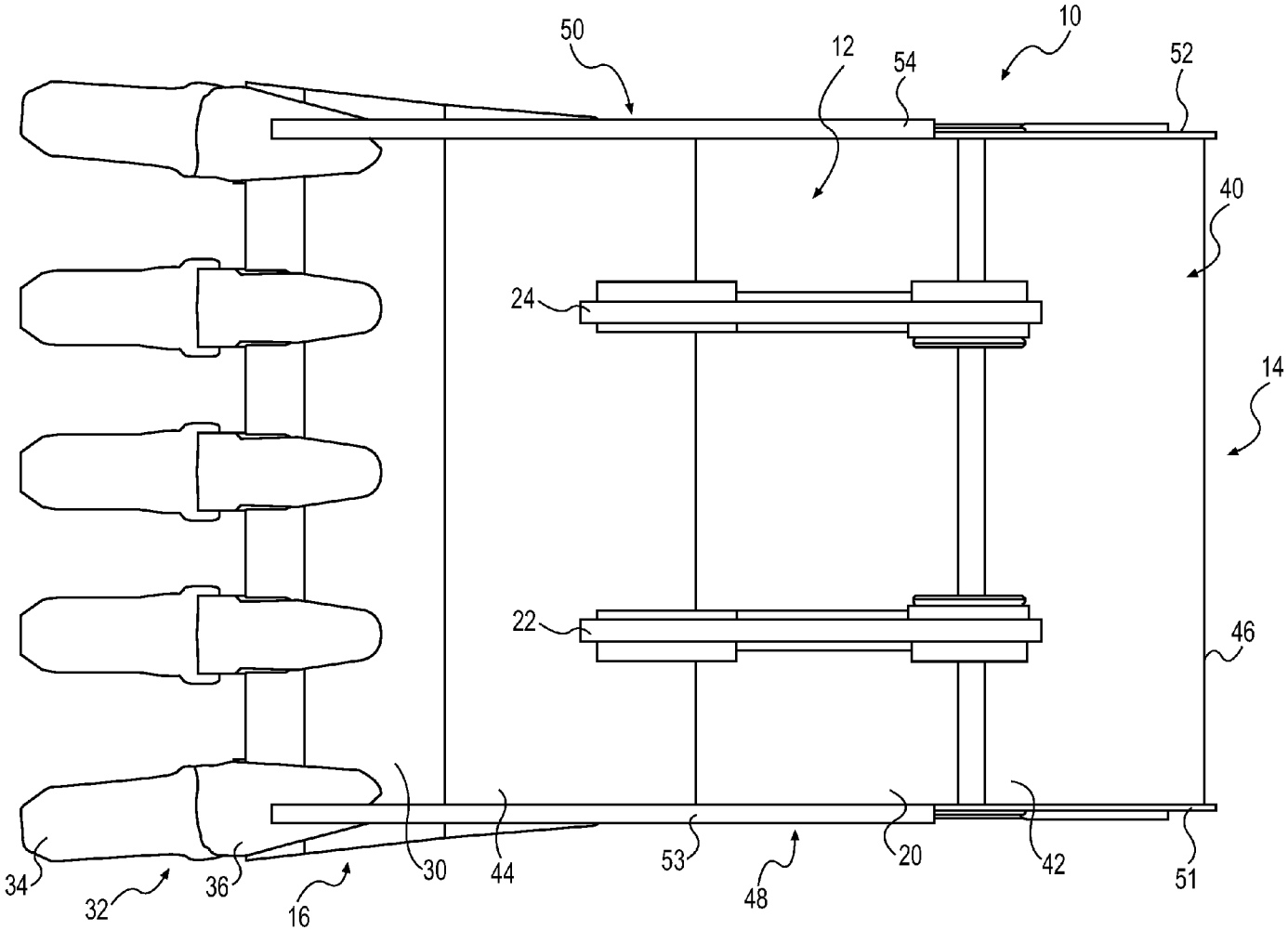
FIG. 4 is a top view of the bucket of FIG. 1.

As shown in FIGS. 1, 3, and 4, bucket 10 includes a top section 12, a middle section 14, and a bottom section 16. Top section 12 includes a support plate 18. A torque tube 20 is coupled to support plate 18. For example, a first end portion of torque tube 20 may be welded to a first end portion of support plate 18, and a second end portion of torque tube 20 may be welded to a top surface of a second end portion of support plate 18. A first hinge plate 22 is coupled to support plate 18 and torque tube 20, and a second hinge plate 24 (FIG. 4), similar to first hinge plate 22, is coupled to support plate 18 and torque tube 20. First hinge plate 22 may include an upper pin bore 26 and a lower pin bore 28, configured to receive first and second pins of the linkage assembly of a machine, to operatively couple bucket 10 to the machine. Second hinge plate 24 may include similar upper and lower pin bores.

Middle section 14 includes a wrapper 40 having a first end 41 substantially straight upper portion 42 coupled to support plate 18, a substantially straight lower portion 44, a second end 47, and a curved heel portion 46 extending between the substantially straight upper and lower sections 42 and 44. Substantially straight lower portion 44 is coupled to a cutting edge 30 of bottom section 16. For example, cutting edge 30 may be welded to second end 47 of wrapper 40. Cutting edge 30 is configured to engage and penetrate material. Bottom section 16 may also include one or more tooth assemblies 32. Tooth assemblies 32 may be coupled to cutting edge 30, and each tooth assembly may include a tooth 34 and a tooth holder 36.

Figure 2:
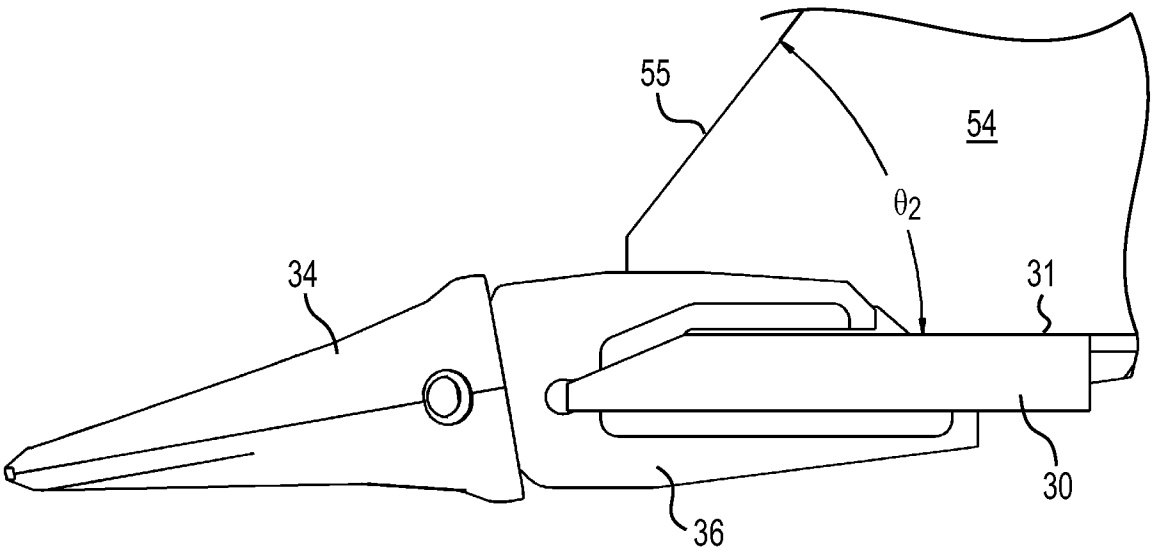
FIG. 2 is an enlarged portion of the bucket side view of FIG. 1.

Bucket 10 also includes a first side section 48 (shown in FIG. 4, but removed from FIGS. 1-3 to illustrate interior features of bucket 10). First side section 48 is coupled to a first side of support plate 18, torque tube 20, wrapper 40, and cutting edge 30; and second side section 50 is coupled to a second side of support plate 18, torque tube 20, wrapper 40, and cutting edge 30, the second side being located opposite the first side. As shown in FIGS. 1, 3, and 4, second side section 50 includes a side plate 52 and a side bar 54. First side section 48 also includes a side plate and a side bar (FIG. 4) similar to side plate 52 and side bar 54 of second side section 50. Support plate 18, wrapper 40, cutting edge 30, first side section 48, and second side section 50, may define a receptacle 56 configured to receive material.

A number of bucket parameters are identified in FIGS. 1-3. Bucket parameters include, for example, a tip radius $R_T$, a tip forward angle $\theta_1$, a depth D, a depth D', a length L, a length L', a lower wrapper radius $R_1$, an upper wrapper radius $R_2$, an upper radius angle $\theta_U$, a lower radius angle $\theta_L$, a hinge support plate angle $\theta_T$, a floor length A, a floor angle $\theta_F$, and a side bar angle $\theta_2$.

As shown in FIG. 1, tip radius $R_T$ is equal to a distance between a center of upper pin bore 26 and a tip of bottom section 16. The tip of bottom section 16 includes a point on bottom section 16 farthest away from upper pin bore 26. The tip of bottom section 16 may include, for example, a tip of tooth 34.

Tip forward angle $\theta_1$ is equal to an angle formed between a tip forward line 60 and a line 62. Tip forward line 60 extends from a center of upper pin bore 26 to the tip of bottom section 16, such as the tip of tooth 34. Line 62 extends substantially perpendicularly from substantially straight lower portion 44 of wrapper 40 and through the center of upper pin bore 26. It should be understood that the term "plane" may be substituted for the term "line" with respect to the lines used to define the parameters of bucket 10.

A first throat line 64 extends between a tip of cutting edge 30 and an outer surface of torque tube 20. The position of first throat line 64 may be found by drawing a line that extends from the tip of cutting edge 30 to torque tube 20, the line being tangential to an outer surface of torque tube 20 and terminating at the tangent point. Length L is equal to a length of first throat line 64. Depth D is equal to a length of the longest line extending perpendicularly from first throat line 64 to wrapper 40.

A second throat line 66 extends between a tip of cutting edge 30 and a portion of torque tube 20. The portion of torque tube 20 is a point where a line defining a lower surface of support plate 18 intersects an outer surface of torque tube 20. Length L' is equal to a length of second throat line 66. Depth D' is equal to a length of the longest line extending perpendicularly from second throat line 66 to wrapper 40.

As shown in FIG. 1, a curved lower portion 68 of curved heel portion 46 extends between substantially straight lower portion 44 of wrapper 40 and a curved upper portion 70 of curved heel portion 46. Curved lower portion 68 may approximate a portion of a circle having a radius $R_1$ (referred to herein as lower wrapper radius $R_1$). Curved upper portion 70 extends between curved lower portion 68 and substantially straight upper portion 42 of wrapper 40. Curved upper portion 70 may approximate a portion of a circle having a radius $R_2$ (referred to as upper wrapper radius $R_2$). Lower radius angle $\theta_L$ is equal to the angle between a line 72 (extending from a center 74 of the portion of the circle defined by curved lower portion 68 to an end 100 of curved lower portion 68) and a line 76 (extending from center 74 to an end 102 of curved lower portion 68). In other words, lower radius angle $\theta_L$, is equal to a central angle of the arc defined by curved lower portion 68. Upper radius angle $\theta_U$ is equal to the angle between a line 78 (extending from a center 80 of the portion of the circle defined by curved upper portion 70 and a end 98 of curved upper portion 70) and a line 82 (extending from center 80 to an end 96 of curved upper portion 70). In other words, upper radius angle $\theta_U$ is equal to a central angle of the arc defined by curved upper portion 70.

A first end 88 of substantially straight upper portion 42 coincides with first end 41 of wrapper 40. A second end 90 of substantially straight upper portion 42 coincides with first end 96 of curved upper portion 70. Second end 90 of substantially straight upper portion 42 (and first end 96 of curved upper portion 70) may be located where a substantially curved portion of wrapper 40 is encountered when moving from first end 41 to second end 47 of wrapper 40. It should be understood that substantially straight upper portion 42 may be slightly curved and/or have one or more slightly curved regions. These slightly curved regions may be more curved than the entirely straight region, but less curved than any region of curved heel portion 46. For example, substantially straight upper portion 42 may include a slightly curved transition region proximate its second end 90 as substantially straight upper portion 42 transitions into curved upper portion 70. In such a transition region, the radius of curvature of substantially straight upper portion 42 decreases when moving toward curved upper portion 70. Second end 90 of substantially straight upper portion 42 (and first end 96 of curved upper portion 70) may be located where the radius of curvature of substantially straight upper portion 42 ceases to decrease.

A first end 92 of substantially straight lower portion 44 coincides with second end 47 of wrapper 40. A second end 94 of substantially straight lower portion 44 coincides with first end 100 of curved lower portion 68. Second end 94 of substantially straight lower portion 44 (and first end 100 of curved lower portion 68) may be located where a substantially curved portion of wrapper 40 is encountered when moving from second end 47 to first end 41 of wrapper 40. It should be understood that substantially straight lower portion 44 may be slightly curved and/or have one or more slightly curved regions. These slightly curved regions may be more curved than a straight region, but less curved than any region of curved heel portion 46. For example, substantially straight lower portion 44 may include a slightly curved transition region proximate its second end 94 as substantially straight lower portion 44 transitions into curved lower portion 68. In such a transition region, the radius of curvature of substantially straight lower portion 44 decreases when moving toward curved lower portion 68. Second end 94 of substantially straight lower portion 44 (and first end 100 of curved lower portion 68) may be located where the radius of curvature of substantially straight lower portion 44 ceases to decrease.

Second ends 98 and 102 of curved upper portion 70 and curved lower portion 68 coincide. Curved upper portion 70 has a radius of curvature approximating upper wrapper radius $R_2$. Curved lower portion 68 has a radius of curvature approximating lower wrapper radius $R_1$. First end 96 of curved upper portion 70 may be located at the first point on wrapper 40 where wrapper 40 has the radius of curvature approximating upper wrapper radius $R_2$, when moving from first end 41 to second end 47 of wrapper 40. First end 100 of curved lower portion 68 may be located at the first point on wrapper 40 where wrapper 40 has the radius of curvature approximating lower wrapper radius $R_1$, when moving from second end 47 to first end 41 of wrapper 40. Second end 98 of curved upper portion 70 (and second end 102 of curved lower portion 68) may be located at the point on wrapper 40 where the radius of curvature of wrapper 40 changes from approximating upper wrapper radius $R_2$ to approximating lower wrapper radius $R_1$.

It should be understood that the radius of curvature of curved upper portion 70 and/or curved lower portion 68 may vary slightly. For example, the radius of curvature of curved upper portion 70 may be a first value in one region of curved upper portion 70, and a second value, slightly different from the first value, in another region of curved upper portion 70. Similarly, it is also contemplated that the radius of curvature of curved lower portion 68 may have a first value in one region of curved lower portion 68, and a second value, slightly different from the first value, in another region of curved lower portion 68. For example, curved upper portion 70 may include a transition region proximate its second end 98, where curved upper portion 70 transitions into curved lower portion 68, and curved lower portion 68 may include a transition region proximate its second end 102 where curved lower portion 68 transitions into curved upper portion 70. In the transition region of curved upper portion 70, the radius of curvature of curved upper portion 70 slightly increases in the direction of curved lower portion 68. In the transition region of curved lower portion 68, the radius of curvature of curved lower portion 68 slightly decreases in the direction of curved upper portion 70. Second end 98 of curved upper portion 70 and second end 102 of curved lower portion 68 may be located, for example, at a point on curved heel portion 46 having a radius of curvature midway between the radius of curvature of curved upper portion 70 (outside its transition region) and the radius of curvature of curved lower portion 68 (outside its transition region).

Referring to FIG. 1, hinge support plate angle $\theta_T$ may be equal to an angle between a top surface of cutting edge 30 and a bottom surface of support plate 18. Additionally or alternatively, hinge support plate angle $\theta_T$ may be equal to an angle between substantially straight upper and lower portions 42 and 44 of wrapper 40.

Floor length A is equal to the length of substantially straight lower portion 44 of wrapper 40. Floor angle $\theta_F$ is equal to an angle between line 62 and a line 84 extending between a center of upper pin bore 26 and the point at which substantially straight lower portion 44 of wrapper 40 meets curved lower portion 68.

Side bar angle $\theta_2$ is shown in FIG. 2. Side bar angle $\theta_2$ is equal to an angle between a top surface 31 of cutting edge 30 and a lower edge portion 55 of side bar 54.

Examples of bucket 10 are described below.

Example 1

Bucket 10 may have a value for tip radius $R_T$ of approximately 1,482 mm, a value for tip forward angle $\theta_1$ of approximately 34.5°, a value for depth D of approximately 770 mm, a value for length L of approximately 1,233 mm, a value for the ratio of D/L of approximately 0.625, a value for depth D' of approximately 781 mm, a value for length L' of approximately 1,091 mm, a value for the ratio of D'/L' of approximately 0.716, a value for lower wrapper radius $R_1$ of approximately 725 mm, a value for upper wrapper radius $R_2$ of approximately 320 mm, a value for the radius ratio of $R_2/R_1$ of approximately 0.44, a value for upper radius angle $\theta_U$ of approximately 110°±0.5°, a value for lower radius angle $\theta_L$ of approximately 45°±0.5°, a value for hinge support plate angle $\theta_T$ of approximately 25°, a value for floor length A of approximately 231 mm, a value for floor angle $\theta_F$ of approximately −1.9°, and a value for side bar angle $\theta_2$ of approximately 53.6°.

Example 2

Bucket 10 may have a value for tip radius $R_T$ of approximately 1,578 mm, a value for tip forward angle $\theta_1$ of approximately 35°, a value for depth D of approximately 830 mm, a value for length L of approximately 1,289 mm, a value for the ratio of D/L of approximately 0.644, a value for depth D' of approximately 821 mm, a value for length L' of approximately 1176 mm, a value for the ratio of D'/L' of approximately 0.698, a value for lower wrapper radius $R_1$ of approximately 795 mm, a value for upper wrapper radius $R_2$ of approximately 331 mm, a value for the radius ratio of $R_2/R_1$ of approximately 0.42, a value for upper radius angle $\theta_U$ of approximately 110°±0.5°, a value for lower radius angle $\theta_L$ of approximately 45°±0.5°, a value for hinge support plate angle $\theta_T$ of approximately 25°, a value for floor length A of approximately 248 mm, a value for floor angle $\theta_F$ of approximately 2.0°, and a value for side bar angle $\theta_2$ of approximately 51.9°.

Example 3

Bucket 10 may have a value for tip radius $R_T$ of approximately 1,661 mm, a value for tip forward angle $\theta_1$ of approximately 35°, a value for depth D of approximately 872 mm, a value for length L of approximately 1,363 mm, a value for the ratio of D/L of approximately 0.640, a value for depth D' of approximately 861 mm, a value for length U of approximately 1,239 mm, a value for the ratio of D'/L' of approximately 0.695, a value for lower wrapper radius $R_1$ of approximately 836 mm, a value for upper wrapper radius $R_2$ of approximately 345 mm, a value for the radius ratio of $R_2/R_1$ of approximately 0.41, a value for upper radius angle $\theta_U$ of approximately 110°±0.5°, a value for lower radius angle $\theta_L$ of approximately 45°±0.5°, a value for hinge support plate angle $\theta_T$ of approximately 25°, a value for floor length A of approximately 301 mm, a value for floor angle $\theta_F$ of approximately 2.0, and a value for side bar angle $\theta_2$ of approximately 52°.

Examples of bucket 10 described above possess performance enhancing geometries, especially when used with materials that tend to adhere to the interior surface of the bucket. Differences between the examples demonstrate that some variability of the values for bucket parameters is contemplated. For example, values may vary depending on the desired overall size of bucket 10, and/or parameters associated with the linkage assembly used to coupled bucket 10 to a machine, the characteristics of the material being moved, and combinations thereof.

INDUSTRIAL APPLICABILITY

The performance enhancing characteristics of a bucket 10 may come as a result of the values of its parameters. The parameters of bucket 10 are identified in FIGS. 1-3. For example, bucket 10 may have a value for tip forward angle value $\theta_1$ of approximately 35° (35°+/−0.5). This tip forward angle $\theta_1$ value may provide a machine operator with line of sight to a tip of a bottom section 16 of bucket 10, such as a tip of a tooth 34 coupled to a cutting edge 30 of bucket 10. As the machine operator moves material with bucket 10, the line of sight provided by the tip forward angle value $\theta_1$ of approximately 35° may provide the machine operator with the ability to move and place bucket 10 accurately. Thus, unnecessary bucket movements may be avoided, such as those that may be required to bring bucket 10 to a target location when bucket 10 has accidentally been placed away from the target location. Accordingly, operations may be performed more quickly, and the amount of material moved per unit fuel may be reduced, producing cost savings.

Further, the tip forward angle value $\theta_1$ of approximately 35° may provide the machine operator with line of sight into at least a portion of a receptacle 56 of bucket 10. This may provide the machine operator with the ability to visually determine, during filling, whether bucket 10 is fully filled with material or has additional capacity for material. Thus, the machine operator may avoid wasting time trying to fill a fully filled bucket with additional material or performing operations with only partially filled buckets. Accordingly, by using bucket 10, cycle times may decrease, fuel may be conserved, and overall costs may be reduced.

Bucket 10 may have values for depth D' and length L' that produce a ratio of D'/L' in a range of approximately 0.69 to 0.72. Maintaining this ratio of D'/L' ensures that depth D' and length L' are proportional to each other. This proportionality strikes a balance between two considerations. The first consideration being the ease by which material enters into and exits from bucket 10; and the second consideration being the amount of material that can be loaded into bucket 10 per cycle. If a bucket has a ratio of D'/L' that exceeds the desired range due to the depth D' being too large relative to length L' (or the length L' being too small relative to the depth D'), the bucket may have sufficient capacity, but may operate inefficiently. One reason for this is that if the length L' of the bucket is smaller than the length L' of bucket 10, the opening by which material enters into and exits out of the bucket will be smaller than the opening by which material enters into and exits out of bucket 10. The smaller opening makes the bucket more difficult to load and unload than bucket 10. Particulate materials (e.g. soil or the like) that tend to adhere to itself and to the bucket will also be more likely to adhere to the interior surface of the bucket with a smaller bucket opening. Further, if the depth D' of the bucket is larger than the depth D' of bucket 10, the material entering into the bucket must travel across a greater distance before reaching the back of the bucket during filling than would be the case with bucket 10, and must also travel back across that greater distance during dumping. The added travel time for material entering into and exiting out of bucket 10 may drive up cycle times. The additional bucket depth will also provide additional interior surface area for materials to adhere to the bucket, increasing material carryback and reducing the bucket's effective capacity If a bucket has a value for the ratio of D'/L' that falls below the desired range of 0.69 to 0.72 due to the depth D' being too small relative to length L' (or the length U being too large relative to the depth D'), the bucket may be loaded and unloaded quickly, but may be lacking in terms of capacity. The bucket may be easier to dump and load than bucket 10 due to the size of the opening associated with having a relative large length L', but less material will be dumped and loaded for each pass with the bucket than with bucket 10 due to the reduced capacity associated with having a relative small depth D'. Furthermore, the effective capacity of the bucket is reduced if the material filling the bucket adheres to its interior surfaces. By keeping the value for the ratio of D'/L' in desired range of 0.69 to 0.72, a balance between ease of loading and dumping, bucket capacity, and effective bucket capacity may exist for bucket 10, thus helping to avoid the inefficiencies described above.

Bucket 10 may have a value for upper radius angle $\theta_U$ in a range of approximately 110°±0.5°. Having the upper radius angle $\theta_U$ in the desired range provides bucket 10 with a curved profile that produces a clearance between an outer surface of a wrapper 40 of bucket 10 and material engaged by bucket 10 during movement of bucket 10. The clearance may help reduce wear on the outer surface of wrapper 40. Without the clearance, wrapper 40 would rub against material more frequently and/or with greater force, thus accelerating wear. Because these parameters also affect the interior shape of the bucket, they have an influence on the ability of the bucket to efficiently dump material that may tend to adhere to the interior surface of the bucket and reduce its effective capacity and the efficiency of its operation.

Providing bucket 10 with a value for lower radius angle $\theta_L$ in a range of approximately 45°±0.5° helps to ensure that for bucket 10, capacity is not sacrificed for the sake of providing the clearance between the outer surface of wrapper 40 and material engaged by bucket 10. For example, if a bucket's upper radius angle $\theta_U$ is increased beyond the desired range, and/or the bucket's lower radius angle $\theta_L$ is decreased below the desired range, the bucket's receptacle may become increasingly tighter, reducing the bucket's capacity for holding material, making loading and dumping the bucket more difficult, and increasing the tendency of material to adhere to the interior surface of the bucket. If a bucket's lower radius angle $\theta_L$ is increased beyond the desired range, and/or the bucket's upper radius angle $\theta_U$ is decreased below the desired range, that bucket's capacity may increase, but the clearance between the outer surface of wrapper 40 and the material may be reduced, thus increasing the wear on bucket 10. Keeping the values for the upper radius angle $\theta_U$ and the lower radius angle $\theta_L$ in their desired ranges may balance bucket capacity with bucket clearance as well as reducing the tendency of adherent material in the bucket lowering the bucket capacity and reducing the efficiency of the bucket.

Bucket 10 may have a value for a ratio of upper wrapper radius $R_2$ to lower wrapper radius $R_1$ of between approximately 0.41 to 0.45. Maintaining the desired ratio ensures that lower wrapper radius $R_1$ and upper wrapper radius $R_2$ are proportional to each other. This proportionality helps to ensure that bucket 100 has a shape with the above-described clearance, that bucket 10 has sufficient depth to reduce material spillage, the shape reduces the tendency for adherent materials from sticking to the interior surface of the bucket, and that cutting edge 30 of bucket 10 is positionable to penetrate material efficiently without generating forces on the top and bottom surfaces of cutting edge 30, when engaging material, that reach levels that may cause machine 10 to stall, hinder movement of bucket 10 to its desired position, unbalance machine 10, or cause any other inefficiencies.

Bucket 10 may have a value for hinge support plate angle $\theta_T$ of approximately 25°. A bucket's hinge support plate angle $\theta_T$ may have an effect on its capacity and the ratio of D'/L'. If a bucket's hinge support plate is fixed about the position 200 shown in FIG. 1, and the hinge support plate angle $\theta_T$ is smaller than the desired value, the bucket's capacity may increase, but the ratio of D'/L' would increase for a given upper wrapper radius R2, thus increasing the tendency of material to adhere to the interior surface of the bucket. If a bucket's hinge support plate angle $\theta_T$ is larger than the desired value, the bucket may lack sufficient capacity. By providing bucket 10 with a value for hinge support plate angle $\theta_T$ of approximately 25°, a balance is achieved between bucket capacity and the ratio of D'/L' that ensures that bucket 10 has the capacity to move material efficiently, and reduces the tendency for adherent materials to stick to the interior of the bucket.

Bucket 10 may also have a value for side bar angle $\theta_2$ of approximately 52 to 54°. Providing a side bar angle $\theta_2$ at approximately 52° may help enhance the ability of bucket 10 to penetrate material, while ensuring that bucket capacity will not have to be de-rated in accordance with ISO standards. For example, if the side bar angle $\theta_2$ is decreased, such a change may allow bucket 10 to penetrate material more easily. However, such a change may also require that bucket 10 be de-rated in accordance with ISO standards that take the side bar angle $\theta_2$ into account when rating bucket capacity. On the other hand, if the side bar angle $\theta_2$ is increased, such a change may make it more difficult to penetrate material with bucket 10, which may hurt efficiency. The side bar angle $\theta_2$ of approximately 52° ensures that bucket 10 will not be de-rated, and configures side bars 53 and 54 of bucket 10 such that they can efficiently penetrate material. Alternatively, bucket 10 may have a value for side bar angle $\theta_2$ of approximately 54°, while still achieving the above-outlined benefits, if other bucket parameters have values making the side bar angle $\theta_2$ of approximately 54° the proper value for ensuring that bucket 10 will not be de-rated and can efficiently penetrate material Bucket 10 may also have a value for floor angle $\theta_F$ of between approximately 1.9° and 2.1°. A floor angle $\theta_F$ below the desired range may give bucket 10 increased capacity, but may reduce some of the clearance between the outer surface of wrapper 40 and the material engaged by bucket 10. This reduction in clearance may make it more difficult to curl bucket 10, and may accelerate wear on bucket 10. Conversely, altering bucket 10 to have a floor angle $\theta_F$ that exceeds the desired range may reduce the capacity of bucket 10, allowing less material to be moved per cycle, but may also provide additional clearance between wrapper 40 and material. Keeping the floor angle $\theta_F$ value in the desired range may provide the clearance between the outer surface of wrapper 10 without sacrificing capacity. A value for floor angle $\theta_F$ of between approximately 1.9° and 2.1°, in combination with other parameters for the bucket, may improve the performance of the bucket when adherent materials are being moved using the bucket.

It will be apparent to those skilled in the art that various modifications and variations can be made in the disclosed buckets without departing from the scope of the disclosure. Additionally, other embodiments of the disclosed buckets will be apparent to those skilled in the art from consideration of the specification. It is intended that the specification and examples be considered as exemplary only, with a true scope of the disclosure being indicated by the following claims and their equivalents.

What is claimed is:

1. A machine bucket, comprising:

a wrapper forming a portion of a receptacle for holding material, the wrapper including:

a curved upper portion defining an arc having a central angle value ($\theta_U$) of between approximately 109.5° and 110.5°, and a curved lower portion defining an arc having a central angle value ($\theta_L$) of between approximately 44.5° and 45.5°; and a cutting edge coupled to an end portion of the wrapper wherein the curved upper portion of the wrapper has a radius of curvature $R_2$ and the curved lower portion has a radius of curvature of $R_1$ where $R_2$ does not equal $R_1$.

2. The machine bucket of claim 1, wherein a ratio of the radius of curvature $R_2$ to the radius of curvature $R_1$ has a value of between approximately 0.41 to 0.45.

3. The machine bucket of claim 1, further including:

a support plate coupled to a first end portion of the wrapper, the support plate including a bottom surface lying in a first plane;

a torque tube coupled to a top surface of the support plate; and a cutting edge coupled to a second end portion of the wrapper.

4. The machine bucket of claim 3, wherein an angle ($\theta_T$) between the first end portion of the wrapper and the second end portion of the wrapper has a value of approximately 25°.

5. The machine bucket of claim 3, further including:

a hinge plate coupled to the torque tube, the hinge plate including an upper pin bore and a lower pin bore; and a tooth assembly coupled to the cutting edge, the tooth assembly having a tooth tip;

wherein a second plane extends from the tooth tip to a center of the upper pin bore, a third plane extends substantially perpendicularly from the wrapper to the center of the upper pin bore, and an angle ($\theta_1$) between the second plane and the third plane has a value of approximately 35°.

6. The machine bucket of claim 3, further including:

a side section including a side plate and a side bar, the side bar including an edge, wherein an angle ($\theta_2$) between a top surface of the cutting edge and at least a portion of the edge of the side bar has a value of approximately 50° to 54°.

7. The machine bucket of claim 3, wherein a second plane extends through a tip of the cutting edge to a portion of an outer surface of the torque tube that lies in the first plane, and a ratio of a maximum distance (D') between the second plane and the wrapper, taken perpendicularly from the second plane to the wrapper, to a length (L') between the tip of the cutting edge and the portion of the outer surface of the torque tube along the second plane, has a value of between approximately 0.69 and 0.71.

8. A machine bucket, comprising:

a torque tube having an outer surface;

a support plate coupled to the torque tube, the support plate including a bottom surface lying in a first plane;

a cutting edge including a cutting edge tip; and a wrapper between the support plate and the cutting edge; and a depth (D') to length (L') ratio of between approximately 0.69 and 0.72, wherein the length (L') extends in a second plane from the cutting edge tip to a portion of the outer surface of the torque tube, the portion of the outer surface being located where the first plane intersects the outer surface of the torque tube, and the depth (D') equals a maximum distance between the second plane and the wrapper, taken substantially perpendicularly from the second plane.

9. The machine bucket of claim 8, wherein the wrapper includes a curved upper portion and a curved lower portion, and the maximum distance extends from the second plane to the curved upper portion of the wrapper.

10. The machine bucket of claim 9, wherein the curved upper portion defines an arc having a central angle value ($\theta_U$) of between approximately 109.5° and 110.5°.

11. The machine bucket of claim 9, wherein the curved lower portion defines an arc having a central angle value ($\theta_L$) of between approximately 44.5° and 45.5°.

12. The machine bucket of claim 9, wherein the wrapper includes a substantially straight upper portion and a substantially straight lower portion, and an angle ($\theta_T$) between the substantially straight upper portion and the substantially straight lower portion has a value of approximately 25°.

13. The machine bucket of claim 12, further including:

a hinge plate coupled to the outer surface of the torque tube, the hinge plate having an upper pin bore and a lower pin bore; and a tooth assembly coupled to the cutting edge, the tooth assembly including a tooth tip.

14. The machine bucket of claim 13, wherein an angle ($\theta_1$) formed between a third plane extending from the tooth tip to a center of the upper pin bore, and a fourth plane extending substantially perpendicularly from the substantially straight lower portion of the wrapper to the center of the upper pin bore, has a value of approximately 35°.

15. The machine bucket of claim 9, further including a side bar and a side plate, the side bar including an edge, wherein an angle ($\theta_2$) formed between a top surface of the cutting edge and at least a portion of the edge of the side bar has a value of approximately 50°.

16. The machine bucket of claim 9, further including a side bar and a side plate, the side bar including an edge, wherein an angle ($\theta_2$) formed between a top surface of the cutting edge and at least a portion of the edge of the side bar has a value greater than 54°.

17. A machine bucket, comprising:

a top section including a support plate and a torque tube coupled to the support plate;

a bottom section including a cutting edge; and a middle section including a wrapper, the wrapper extending between the torque tube and the cutting edge, wherein the wrapper includes:

an upper portion coupled to the support plate, a lower portion coupled to the cutting edge, and a curved heel portion between the upper portion and the lower portion, an angle ($\theta_T$) between the upper portion and the lower portion having a value of approximately 25°; and a depth (D') to length (L') ratio of between approximately 0.69 and 0.72, wherein a distance between a tip of the cutting edge and a portion of an outer surface of the torque tube, the portion of the outer surface lying in a first plane containing a bottom surface of the support plate, defines the length (L'), and a maximum distance between a second plane containing the length (L') and the wrapper, taken substantially perpendicularly from the second plane, defines the depth (D').

18. The machine bucket of claim 17, further including a hinge plate coupled to the torque tube, the hinge plate including an upper pin bore and a lower pin bore.

19. The machine bucket of claim 18, wherein an angle ($\theta_F$) between a third plane extending substantially perpendicularly from the lower portion of the wrapper to a center of the upper pin bore, and a fourth plane extending from the center of the upper pin bore to a location where the lower portion of the wrapper meets the curved heel portion of the wrapper, has a value of between approximately 1.9° and 2.0°.

* * * * *